US012130089B2

(12) United States Patent
Tarui et al.

(10) Patent No.: US 12,130,089 B2
(45) Date of Patent: Oct. 29, 2024

(54) HEAT EXCHANGER, OUTDOOR UNIT, AND AIR-CONDITIONING APPARATUS

(71) Applicant: Mitsubishi Electric Corporation, Tokyo (JP)

(72) Inventors: Takayuki Tarui, Tokyo (JP); Mitsuhiro Ikeda, Tokyo (JP); Hisanori Ueki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 230 days.

(21) Appl. No.: 17/795,263

(22) PCT Filed: Mar. 30, 2020

(86) PCT No.: PCT/JP2020/014509
§ 371 (c)(1),
(2) Date: Jul. 26, 2022

(87) PCT Pub. No.: WO2021/199138
PCT Pub. Date: Oct. 7, 2021

(65) Prior Publication Data

US 2023/0092584 A1 Mar. 23, 2023

(51) Int. Cl.
*F28F 1/02* (2006.01)
*F28F 9/02* (2006.01)

(52) U.S. Cl.
CPC ..... *F28F 1/02* (2013.01); *F28F 9/02* (2013.01)

(58) Field of Classification Search
CPC ..... F28F 1/02; F28F 9/0212; F28F 9/02; F25B 39/02; F25B 39/04; F25B 13/00;
(Continued)

(56) References Cited

U.S. PATENT DOCUMENTS

| | | | |
|---|---|---|---|
| 5,052,477 | A | 10/1991 | Nakajima et al. |
| 9,062,901 | B2 | 6/2015 | Jeon et al. |
| 2002/0023743 | A1 | 2/2002 | Jung et al. |
| 2005/0217831 | A1 | 10/2005 | Manaka |

(Continued)

FOREIGN PATENT DOCUMENTS

| | | | |
|---|---|---|---|
| FR | 2 676 273 | A1 | 11/1992 |
| JP | H10-213390 | A | 8/1998 |

(Continued)

OTHER PUBLICATIONS

Pdf is translation of foreign reference JP-2016095087-A (Year: 2016).*

(Continued)

*Primary Examiner* — Len Tran
*Assistant Examiner* — Kamran Tavakoldavani
(74) *Attorney, Agent, or Firm* — Posz Law Group, PLC

(57) ABSTRACT

A heat exchanger includes: a heat exchange element including flat tubes spaced from each other; and a first header in which one end portion of each of the flat tubes is inserted. The first header includes: a first main header portion in which some of the flat tubes are inserted; a first sub-header portion in which others of the flat tubes are inserted such that the number of the flat tubes inserted in the first sub-header portion is smaller than that of the flat tubes inserted in the first main header portion; and a partition plate provided between the first main header portion and the first sub-header portion, and joined to the first main header portion and the first sub-header portion. The partition plate has a surface area that is larger than a sectional area of the first main header portion and a sectional area of the first sub-header portion.

20 Claims, 6 Drawing Sheets

(58) Field of Classification Search
CPC ..... F25B 2313/0233; F25B 2313/0253; F28D 1/05325; F28D 1/05375; F28D 2021/0071
See application file for complete search history.

(56) References Cited

U.S. PATENT DOCUMENTS

| | | | | |
|---|---|---|---|---|
| 2009/0266528 | A1 | 10/2009 | Saito et al. | |
| 2017/0314792 | A1 | 11/2017 | Jindou et al. | |
| 2018/0149432 | A1* | 5/2018 | Kono | F25B 39/00 |
| 2018/0292138 | A1 | 10/2018 | Roberts et al. | |
| 2020/0025428 | A1* | 1/2020 | Inoue | F28F 1/32 |

FOREIGN PATENT DOCUMENTS

| | | | | |
|---|---|---|---|---|
| JP | 2009-030882 | A | 2/2009 | |
| JP | 2016095087 | A * | 5/2016 | B23K 1/0012 |
| JP | 2017-058078 | A | 3/2017 | |
| JP | 2018-179493 | A | 11/2018 | |
| JP | 2019-052784 | A | 4/2019 | |

OTHER PUBLICATIONS

Office Action dated Jun. 27, 2023 issued in corresponding JP patent application No. 2022-512886 (and English translation).
Office Action dated Feb. 7, 2023 issued in corresponding JP Patent Application No. 2022-512886 (and English machine translation).
Extended European Search Report dated Mar. 21, 2023 issued in corresponding European Patent Application No. 20928908.1.
International Search Report of the International Searching Authority mailed Jun. 9, 2020 in corresponding International Patent Application No. PCTJP2020/014509 (with English machine translation).

* cited by examiner

HEAT EXCHANGER, OUTDOOR UNIT, AND AIR-CONDITIONING APPARATUS

CROSS REFERENCE TO RELATED APPLICATION

This application is a U.S. national stage application of PCT/JP2020/014509 filed on Mar. 30, 2020, the contents of which are incorporated herein by reference.

TECHNICAL FIELD

The present disclosure relates to a heat exchanger including a plurality of flat tubes, and also relates to an outdoor unit and an air-conditioning apparatus.

BACKGROUND ART

A refrigeration cycle circuit of an air-conditioning apparatus includes a heat exchanger that causes heat exchange with air to be performed. It is known that an existing heat exchanger includes a plurality of refrigerant tubes through which refrigerant flows in an up-down direction, and a pair of upper and lower tanks. The pair of upper and lower tanks are connected to upper and lower ends of the refrigerant tubes, respectively, to distribute or collect refrigerant. In the existing heat exchanger, refrigerant is caused to flow, in turn, in refrigerant tubes in a plurality of blocks defined by a partition plate provided in the tanks, such that the refrigerant exchanges heat with air (see, for example, Patent Literature 1).

CITATION LIST

Patent Literature

Patent Literature 1: Japanese Unexamined Patent Application Publication No. 2009-30882

SUMMARY OF INVENTION

Technical Problem

In the heat exchanger disclosed in Patent Literature 1, the partition plate is brazed to the inside of the tanks to partition the tanks into a plurality of blocks. Therefore, in the heat exchanger in Patent Literature 1, even if a defect is present in the brazed part of the partition plate, which may cause occurrence of refrigerant leakage between the blocks, the refrigerant is still prevented from leaking therefrom to the outside of the heat exchanger. It is therefore difficult to detect a defective product. If refrigerant leakage occurs between the blocks, gas refrigerant mixes with two-phase gas-liquid refrigerant, thus deteriorating the heat exchange performance.

The present disclosure is applied to solve the above problems, and relates to a heat exchanger that enables a defective product to be easily detected even if a defect is present at a joint between a header and a partition plate.

Solution to Problem

A heat exchanger according to one embodiment of the present disclosure includes: a heat exchange element including a plurality of flat tubes spaced from each other; and a first header in which one end portion of each of the plurality of flat tubes of the heat exchange element is inserted. The first header includes: a first main header portion in which some of the plurality of flat tubes are inserted; a first sub-header portion in which others of the plurality of flat tubes are inserted such that the number of the flat tubes inserted in the first sub-header portion is smaller than the number of the flat tubes inserted in the first main header portion; and a partition plate provided between the first main header portion and the first sub-header portion, and joined to both the first main header portion and the first sub-header portion. The partition plate has a surface area that is larger than a sectional area of the first main header portion and a sectional area of the first sub-header portion.

An outdoor unit according to another embodiment of the present disclosure includes: the above heat exchanger; a housing which is formed in the shape of a box shape and in which the heat exchanger is provided; and a fan located on a top of the housing and configured to blow air upward. The heat exchanger is provided in an upper portion of the housing.

An air-conditioning apparatus according to still another embodiment of the present disclosure includes the above outdoor unit.

Advantageous Effects of Invention

In the heat exchanger according to one embodiment of the present disclosure, if a defect is present at a joint between the header and the partition plate, refrigerant leaks from the heat exchanger to the outside thereof. Thus, it is possible to easily check whether joining is performed without causing a defective or not. Therefore, it is possible to detect a defective product and reduce the probability with which the defective product will be distributed to the market.

DESCRIPTION OF EMBODIMENTS

A heat exchanger and an air-conditioning apparatus according to each of embodiments of the present disclosure will be described with reference to the drawings. It should be noted that in each of figures to be referred to, components that are the same as or equivalent to those in a previous figure or previous figures are denoted by the same reference signs, and their descriptions will thus be appropriately omitted or simplified. Furthermore, the shape, size, location, etc. of each of components as illustrated in each figure can be appropriately changed within the scope of the present disclosure.

Embodiment 1

Figure 1:
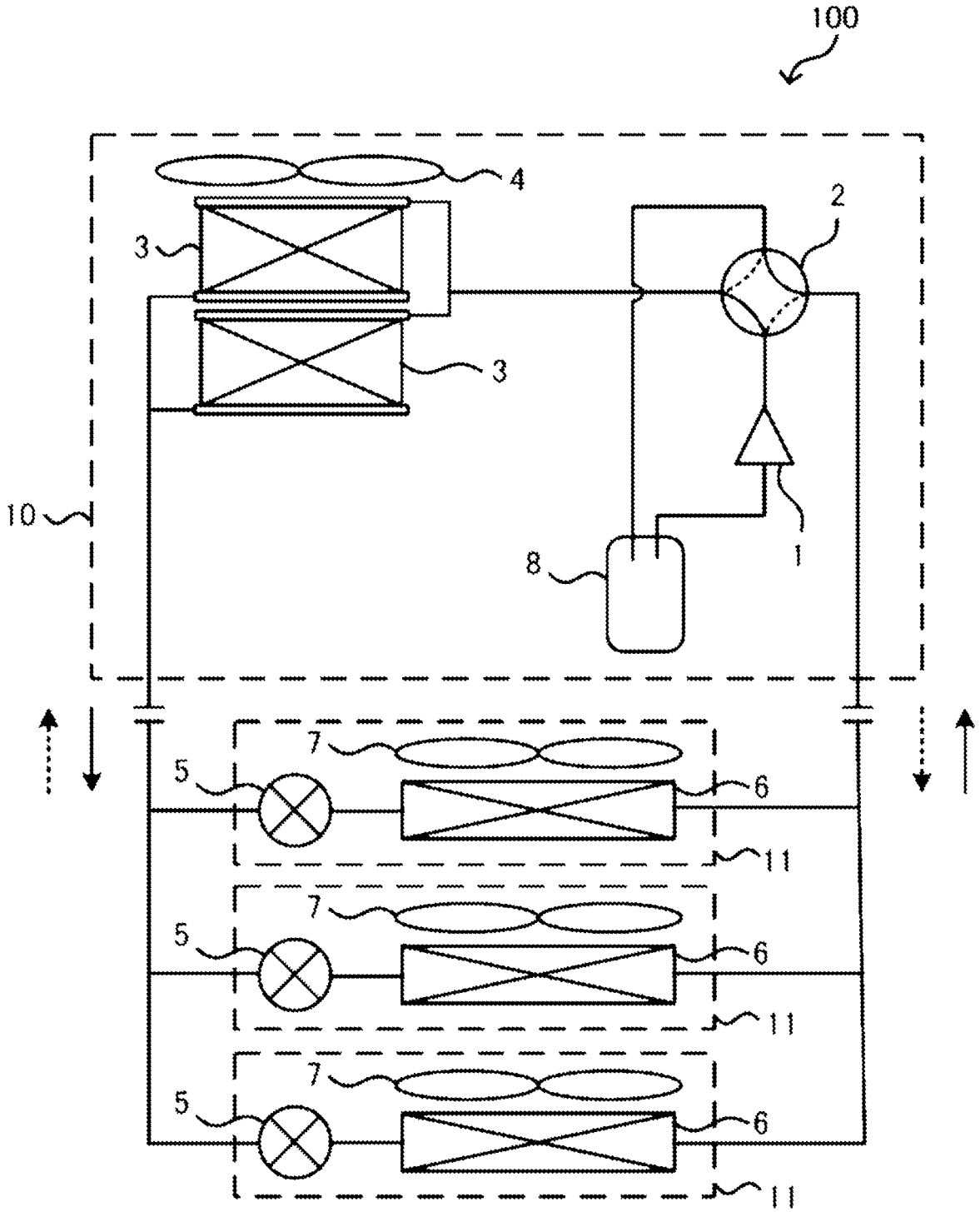
FIG. 1 is a refrigerant circuit diagram illustrating an air-conditioning apparatus according to Embodiment 1 of the present disclosure.

FIG. 1 is a refrigerant circuit diagram illustrating an air-conditioning apparatus 100 according to Embodiment 1 of the present disclosure. The air-conditioning apparatus 100 is installed in, for example, a building or an apartment, and can perform cooling operation, heating operation, and defrost operation by using a refrigeration cycle circuit (heat pump cycle circuit) through which refrigerant circulates. The air-conditioning apparatus 100 includes an outdoor unit 10 and a plurality of indoor units 11. The plurality of indoor units 11 are connected parallel to the outdoor unit 10. The outdoor unit 10 are connected to the plurality of indoor units 11 by refrigerant pipes, whereby the refrigeration cycle circuit is provided. It should be noted that in Embodiment 1, three indoor units 11 are connected to the outdoor unit 10; however, the number of indoor units 11 to be connected to the outdoor unit 10 is not limited to three.

As the refrigerant, the following refrigerant is used: fluorocarbon refrigerant (for example, an HFC-based refrigerant such as R32, R125, or R134a, or a mixture of these refrigerant, such as R410A, R407c, or R404A) or HFO refrigerant (for example, HFO-1234yf, HFO-1234ze (E), or HFO-1234ze (Z)). As refrigerant other than the above refrigerant, refrigerant for use in a vapor-compression heat pump is employed, such as a CO2 refrigerant, an HC refrigerant (for example, propane or isobutane refrigerant), an ammonia refrigerant, or a mixture of the refrigerant described above such as a mixed refrigerant of R32 and HFO-1234yf.

First of all, the refrigeration cycle circuit will be described. The air-conditioning apparatus 100 includes a refrigerant circuit in which a compressor 1, a four-way valve 2, outdoor heat exchangers 3, expansion valves 5, indoor heat exchangers 6, and an accumulator 8 are connected to each other by refrigerant pipes, and refrigerant is circulated.

The outdoor unit 10 has a function of supplying cooling energy or heating energy to the indoor units 11. The outdoor unit 10 includes the compressor 1, the four-way valve 2, the outdoor heat exchangers 3, and the accumulator 8. These components are connected in series to form part of the refrigerant circuit.

The compressor 1 is a fluid machine that compresses sucked low-pressure refrigerant to change it into high-pressure refrigerant, and discharges the high-pressure refrigerant. The compressor 1 is, for example, a rotary compressor or a scroll compressor. It should be noted that the compressor 1 may be, for example, a compressor whose rotation frequency is constant, or a compressor which includes an inverter and whose rotation frequency can be controlled.

The four-way valve 2 is a flow switching device that is provided on the discharge side of the compressor 1 to switch a circulation direction of refrigerant between the circulation direction of the refrigerant for cooling operation and that for heating operation. The flow of the refrigerant during cooling operation and that during heating operation will be described later.

Each of the outdoor heat exchangers 3 is an air-cooled heat exchanger that causes heat exchange to be performed between air and refrigerant that flows in the outdoor heat exchanger 3. The outdoor heat exchanger 3 operates as a condenser during cooling operation or operates as an evaporator during heating operation. The outdoor heat exchanger 3 causes heat exchange to be performed between air and refrigerant that flows in the outdoor heat exchanger 3, by wind created by a fan 4. The fan 4 is, for example, a centrifugal fan such as a sirocco fan or a turbo fan, a cross flow fan, a diagonal flow fan, or a propeller fan. It should be noted that the outdoor heat exchanger 3 corresponds to "heat exchanger" in the present disclosure.

The accumulator 8 is provided on the suction side of the compressor 1, and has a function of separating liquid refrigerant and gas refrigerant from each other, and a function of storing surplus refrigerant therein.

Each of the indoor units 11 supplies cooling energy or heating energy from the outdoor unit 10 to a cooling load or a heating load. The indoor unit 11 includes the expansion valve 5 and the indoor heat exchanger 6, which are connected in series, and forms along with the outdoor unit 10 the refrigerant circuit.

The expansion valve 5 serves as a pressure reducing valve or an expansion valve, and reduces the pressure of refrigerant and expands the refrigerant. The expansion valve 5 is, for example, a pressure reducing device such as a linear electronic expansion valve whose opening degree can be adjusted in multiple stages or continuously.

The indoor heat exchanger 6 is an air-cooled heat exchanger capable of causing heat exchange to be performed between air and refrigerant that flows in the indoor heat exchanger 6. The indoor heat exchanger 6 operates as an evaporator during cooling operation, or operates as a condenser during heating operation. In the indoor heat exchanger 6, heat exchange is performed between air and refrigerant that flows in the indoor heat exchanger 6, by wind created by a fan 7. The fan 7 is, for example, a centrifugal fan such as a sirocco fan or a turbo fan, a cross flow fan, a diagonal flow fan, or a propeller fan.

Next, an operation of the refrigerant circuit in the air-conditioning apparatus 100 will be described. The air-conditioning apparatus 100 receives a request for performing cooling operation, heating operation, or other operation, from, for example, a remote control unit provided in a room. During heating operation, the refrigerant is compressed by the compressor 1 to change into high-temperature and high-pressure gas refrigerant, and the high-temperature then flows into each of the indoor heat exchangers 6 through the four-way valve 2. The refrigerant that has flowed into the indoor heat exchanger 6 is made to transfer heat by wind created by the fan 7, and condenses to liquefy, that is, change into liquid refrigerant. The liquid refrigerant is reduced in pressure by the expansion valve 5 to change into low-temperature and low-pressure two-phase gas-liquid refrigerant, and the low-temperature and low-pressure two-phase gas-liquid refrigerant then flows into each of the outdoor heat exchangers 3. The refrigerant that has flowed into the outdoor heat exchanger 3 exchanges heat with air that is sent as wind created by the fan 4, thereby evaporating to change into gas refrigerant, and the gas refrigerant then flows out of the outdoor heat exchanger 3. The refrigerant that has flowed out of the outdoor heat exchanger 3 is re-sucked into the compressor 1 through the accumulator 8, and is circulated in the refrigerant circuit. As well as the refrigerant, refrigerating machine oil necessary for driving the compressor 1 is also circulated in the refrigerant circuit. In contrast, during cooling operation, refrigerant and refrigerating machine oil are circulated in the refrigerant circuit in the opposite direction to that during heating operation. It should be noted that dotted arrows in FIG. 1 indicate the flow direction of the refrigerant during heating operation, and solid arrows in FIG. 1 indicate the flow direction of the refrigerant during cooling operation.

Figure 2:
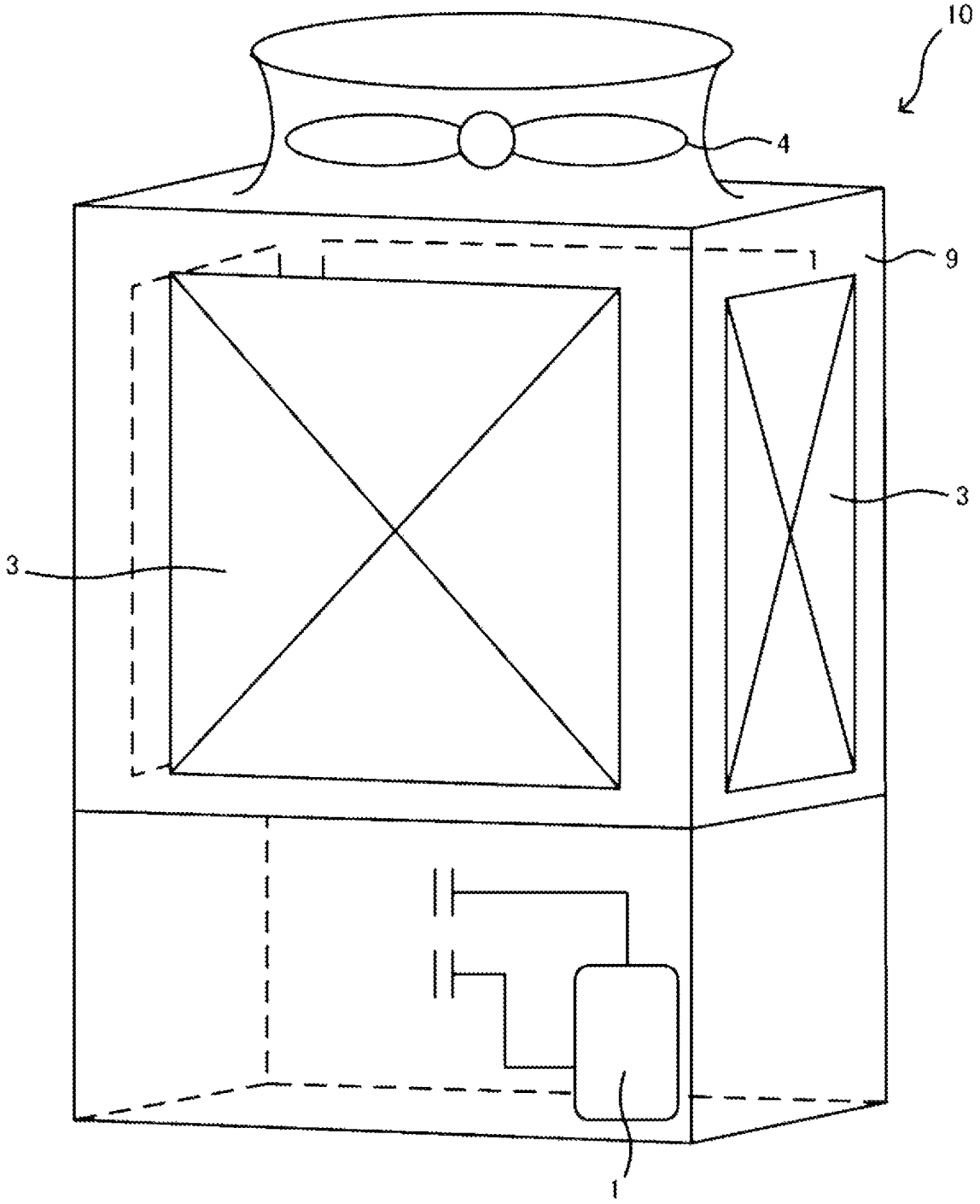
FIG. 2 is a perspective view illustrating an outdoor unit of the air-conditioning apparatus according to Embodiment 1 of the present disclosure.

FIG. 2 is a perspective view illustrating the outdoor unit 10 of the air-conditioning apparatus 100 according to Embodiment 1 of the present disclosure. The outdoor unit 10 of the air-conditioning apparatus 100 includes a housing 9 in the shape of a box. The fan 4 is located in an upper portion of the housing 9. In the housing 9 of the outdoor unit 10, components that form the refrigerant circuit, such as the compressor 1 and the outdoor heat exchangers 3, are provided. The fan 4 is located above the outdoor heat exchangers 3, and blows air upward. That is, the outdoor unit 10 of the air-conditioning apparatus 100 is a top flow outdoor unit in which the fan 4 that flows air upward is located above the outdoor heat exchangers 3. The outdoor heat exchangers 3 are provided at four side portions of the housing 9 that surround a lower projection region of the fan 4. The outdoor heat exchangers 3 are located in the upper portion of the housing 9, which is close to the fan 4. The compressor 1 is located in a lower portion of the housing 9 of the outdoor unit 10. Lower ends of the outdoor heat exchangers 3 are located at higher level than an upper end of the compressor 1.

Figure 3:
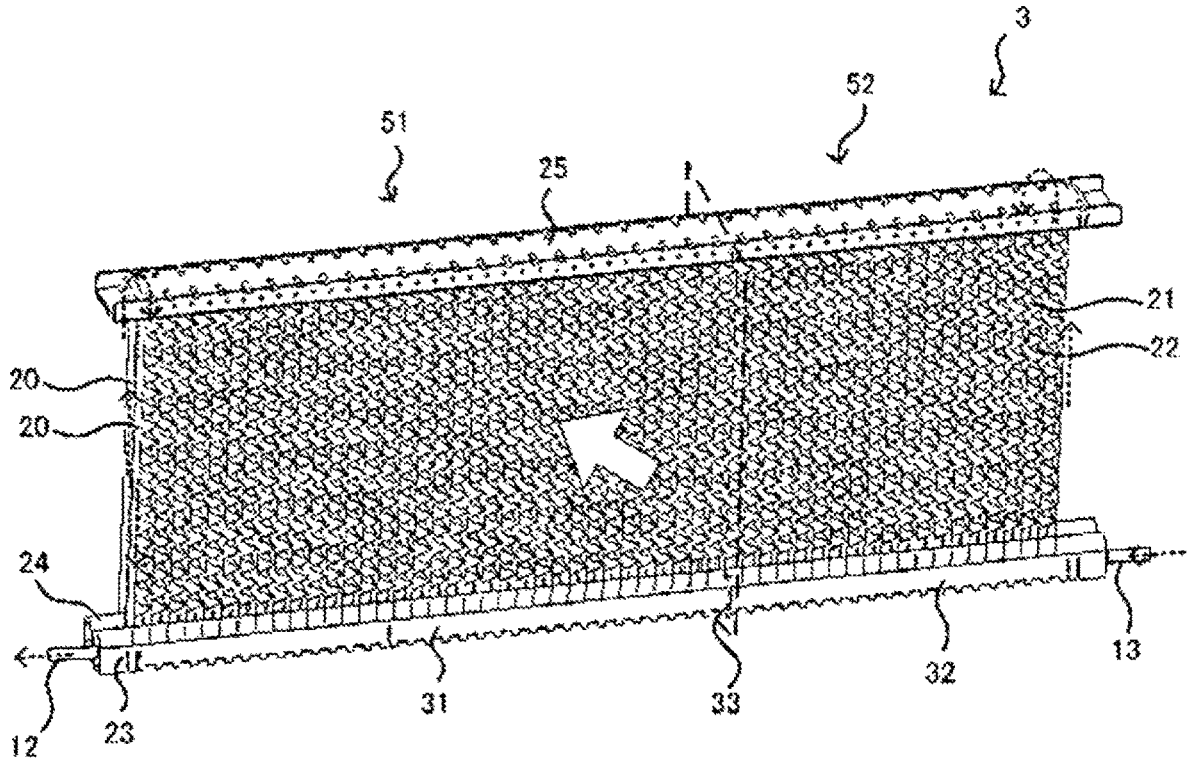
FIG. 3 is a perspective view illustrating an outdoor heat exchanger according to Embodiment 1 of the present disclosure.

FIG. 3 is a perspective view enlargedly illustrating part of the outdoor heat exchanger 3 according to Embodiment 1 of the present disclosure. An outlined arrow in FIG. 3 indicates the flow of wind created by the fan 4. As illustrated in FIG. 3, the outdoor heat exchanger 3 includes a plurality of heat exchange elements 20 in the flow direction of air. Each of the heat exchange elements 20 includes a plurality of flat tubes 21 extending in a vertical direction, and arranged and spaced from each other in a horizontal direction. Each of the heat exchange elements 20 also includes fins 22 joined to the flat tubes 21. Referring to FIG. 3, two heat exchange elements 20 have the same size and are arranged side by side in the flow direction of air. It should be noted that in Embodiment 1, the outdoor heat exchanger 3 includes two heat exchange elements 20; however, the number of heat exchange elements 20 included in the outdoor heat exchanger 3 may be one or three or more.

The plurality of flat tubes 21 are arranged and spaced parallel to each other in the horizontal direction such that wind created the fan 4 passes between the flat tubes 21. Refrigerant flows in the vertical direction in the flat tubes 21 that extend in the vertical direction. The fins 22 are connected between adjacent ones of the flat tubes 21 to transfer heat to the adjacent flat tubes 21. It should be noted that the fins 22 are provided to improve the heat exchange efficiency between air and refrigerant. For example, corrugated fins are used as the fins 22. However, the fins 22 are not limited to the corrugated fins. Since heat exchange between air and refrigerant is performed on the surfaces of the flat tubes 21, it is not indispensable that the fins 22 are provided.

A first header 23 is provided at lower part of one of the heat exchange elements 20 that is located on the most upstream side in the flow direction of the wind. Lower end portions of the flat tubes 21 of the heat exchange element 20 located on the most upstream side in the flow direction of the wind are directly inserted into the first header 23. The first header 23 includes a first main header portion 31, a first sub-header portion 32, and a partition plate 33 located between the first main header portion 31 and the first sub-header portion 32.

In the first header 23, the flat tubes 21 are inserted. Some of these flat tubes 21 are inserted in the first main header portion 31. The first main header portion 31 is connected to the refrigerant circuit in the air-conditioning apparatus 100 by a gas pipe 12. The first main header portion 31 will also be referred to as "gas header." As described later, in cooling operation, the gas pipe 12 allows high-temperature and high-pressure gas refrigerant from the compressor 1 to flow into the outdoor heat exchanger 3, and in heating operation, the gas pipe 12 allows low-temperature and low-pressure gas refrigerant that has been subjected to heat exchange in the outdoor heat exchanger 3 to flow out therefrom to the refrigerant circuit. In other words, the gas pipe 12 is connected to the first main header portion 31, and allows refrigerant to flow into the outdoor heat exchanger 3 when the outdoor heat exchanger 3 operates as a condenser, and allows refrigerant to flow from the outdoor heat exchanger 3 into the refrigerant circuit when the outdoor heat exchanger 3 operates as an evaporator.

Of the flat tubes 2, a smaller number of flat tubes 21 are inserted in the first sub-header portion 32 than in the first main header portion 31. The first sub-header portion 32 is provided alongside of the first main header portion 31 and located at the lower part of the heat exchange element 20 located on the most upstream side in the flow of the wind. The first sub-header portion 32 is connected to the refrigerant circuit in the air-conditioning apparatus 100 by a liquid pipe 13. The first sub-header portion 32 will also be referred to as "liquid header." As described later, in heating operation, the liquid pipe 13 allows low-temperature and low-pressure two-phase refrigerant to flow into the outdoor heat exchanger 3, and in cooling operation, the liquid pipe 13 allows low-temperature high-pressure liquid refrigerant that has been subjected to heat exchange in the outdoor heat exchanger 3 to flow from the outdoor heat exchanger 3 into the refrigerant circuit. In other words, the liquid pipe 13 is connected to the first sub-header portion 32, and allows refrigerant to flow from the outdoor heat exchanger 3 into the refrigerant circuit when the outdoor heat exchanger 3 operates as a condenser, and allows refrigerant to flow into the outdoor heat exchanger 3 when the outdoor heat exchanger 3 operates as an evaporator.

The partition plate 33 is provided between the first main header portion 31 and the first sub-header portion 32 to prevent refrigerant from directly passing between the first main header portion 31 and the first sub-header portion 32. The first main header portion 31, the first sub-header portion 32, and the partition plate 33 will be described later in detail.

A second header 24 is provided at the lower part of one of the heat exchange elements 20 that is located on the most downstream side in the flow of the wind. The second header 24 is located parallel to the first header 23.

At the top of the heat exchange elements 20, a return header 25 is provided. In the return header 25, upper end portions of the flat tubes 21 inserted in the first header 23 and the second header 24 are inserted.

The flat tubes 21, the fins 22, the first header 23, the second header 24, and the return header 25 are all made of aluminum, and joined to each other by brazing. Also, the first main header portion 31, the first sub-header portion 32, and the partition plate 33 that form the first header 23 are all made of aluminum, and joined to each other by brazing. It should be noted that that the above joining method is not limited to brazing. That is, any joining method can be applied as long as the above components can be joined in such a manner as to prevent refrigerant from leaking.

The outdoor heat exchanger 3 is divided into a main heat exchange portion 51 and a sub-heat exchange portion 52 that are associated with the first main header portion 31 and the first sub-header portion 32, respectively, which form the first header 23. The main heat exchange portion 51 and the sub-heat exchange portion 52 are formed adjacent to each other at least one of the four side portions at which the outdoor heat exchangers 3 are located.

The main heat exchange portion 51 is associated with the first main header portion 31 of the first header 23, and includes the first main header portion 31 and a plurality of heat exchange elements 20 located closer to the first main header portion 31 than to the partition plate 33.

The sub-heat exchange portion 52 is associated with the first sub-header portion 32 of the first header 23, and includes the first sub-header portion 32 and a plurality of heat exchange elements 20 that are closer to the first sub-header portion 32 than to the partition plate 33. The main heat exchange portion 51 and the sub-heat exchange portion 52 communicate with each other through the second header 24.

Next, the flow of refrigerant in the outdoor heat exchanger 3 in each of different operations will be described. First, the flow of refrigerant in the outdoor heat exchanger 3 in heating operation will be described. The outdoor heat exchanger 3 operates as an evaporator during heating operation. Two-phase gas-liquid refrigerant that flows from the refrigerant circuit into the outdoor heat exchanger 3 first flows from the liquid pipe 13 into the first sub-header portion 32, then flows in the sub-heat exchange portion 52, and exchanges heat with air of wind created by the fan 4, whereby that the quality of the refrigerant is increased. Thereafter, the refrigerant that has flowed in the sub-heat exchange portion 52 flows into the second header 24 and then into the main heat exchange portion 51. The refrigerant that has flowed into the main heat exchange portion 51 is evenly distributed to the flat tubes 21, exchanges heat with air of wind created by the fan 4, and thus evaporates. After being subjected to the heat exchange, the refrigerant flows out of the gas pipe 12 through the first main header portion 31. At this time, the refrigerant that flows in the main heat exchange portion 51 flows through the flat tubes 21 of the heat exchange element 20 located on the downstream side in the flow of the wind, and flows then through the flat tubes 21 of the heat exchange element 20 located on the upstream side of the airflow, whereby the refrigerant flows in the opposite direction to the flow direction of the air. It should be noted that a dotted arrow in FIG. 3 indicates the flow of the refrigerant during heating operation.

Next, the flow of refrigerant in the outdoor heat exchanger 3 in defrost operation will be described. In a low-temperature environment in which the surface temperatures of the flat tubes 21 and the fins 22 are lower than or equal to 0 degrees C., when the air-conditioning apparatus 100 performs heating operation, frost is formed on the outdoor heat exchanger 3. Therefore, when the amount of the frost formed on the outdoor heat exchanger 3 becomes larger than or equal to a given amount, the air-conditioning apparatus 100 starts defrost operation to melt the frost on a surface of the outdoor heat exchanger 3.

In the defrost operation, the fan 4 is stopped, and the state of the four-way valve 2 in the refrigerant circuit is switched to a cooling operation state, whereby high-temperature gas refrigerant flows into the outdoor heat exchanger 3. As a result, the frost adhering to the flat tubes 21 and the fins 22 melts. In the outdoor heat exchanger 3, in defrost operation, high-temperature gas refrigerant flows in the opposite direction to the flow direction of the refrigerant in the case where the outdoor heat exchanger 3 operates as an evaporator. That is, the gas refrigerant flows into each of the flat tubes 21 through the first main header portion 31 of the main heat exchange portion 51 provided at the lower part of the heat exchange element 20 located on the most upstream side in the flow of wind. The high-temperature refrigerant that has flowed into the flat tubes 21 causes the frost adhering to the flat tubes 21 and the fins 22 to melt gradually from the lower side to change into water. The water is discharged along the flat tubes 21 or the fins 22 to a region below the outdoor heat exchanger 3. After the frost adhering to the flat tubes 21 and the fins 22 melts, defrost operation is ended, and heating operation is then restarted.

Next, the flow of refrigerant in the outdoor heat exchanger 3 in cooling operation will be described. In cooling operation, that is, when the outdoor heat exchanger 3 operates as a condenser, refrigerant flows in the opposite direction to the flow direction of the refrigerant in the case where the outdoor heat exchanger 3 operates as an evaporator, as described above. When the outdoor heat exchanger 3 operates as a condenser, high-pressure gas refrigerant that flows from the refrigerant circuit into the outdoor heat exchanger 3 flows from the gas pipe 12 into the first main header portion 31, and exchanges heat with air of wind created by the fan 4, in the main heat exchange portion 51. As a result, the gas refrigerant changes into two-phase gas-liquid refrigerant, and then flows into the sub-heat exchange portion 52 through the second header 24. The two-phase gas-liquid refrigerant that has flowed into the sub-heat exchange portion 52 exchanges heat with air of wind created by the fan 4. Thus, the two-phase gas-liquid refrigerant condenses to change into liquid refrigerant, and the liquid refrigerant flows out from the liquid pipe 13 through the first sub-header portion 32. At this time, refrigerant that flows in the sub-heat exchange portion 52 flows through the flat tubes 21 of the heat exchange element 20 located on the downstream side in the flow of the wind, and flows then through the flat tubes 21 of the heat exchange element 20 located on the upstream side in the flow of the wind, whereby the refrigerant flows in the opposite direction to the flow direction of air.

As described above, in the above configuration, when the outdoor heat exchanger 3 operates as an evaporator, in the main heat exchange portion 51, a refrigerant flow passage is formed through which refrigerant flows into one of the heat exchange elements 20 that is located on the most downstream side in the flow of the wind, via the second header 24, and then flows out from one of the heat exchange elements 20 that is located on the most upstream side in the flow of the wind, whereby the refrigerant flows in the opposite direction to the flow direction of air. In contrast, when the outdoor heat exchanger 3 operates as a condenser, in the sub-heat exchange portion 52, a refrigerant flow passage is formed through which refrigerant flows into one of the heat exchange elements 20 that is located on the most downstream side in the flow direction of the wind, via the second header 24, and then flows out of one of the heat exchange elements 20 that is located on the most upstream side in the flow of the wind, whereby the refrigerant flows in the opposite direction to the flow direction of air. As a result, it is possible to ensure at all times a temperature difference between air and refrigerant in the process of heat exchange, and improve the heat exchange performance. Thus, the outdoor heat exchanger 3 has a portion in which refrigerant flows in the opposite direction to the flow direction of air when the outdoor heat exchanger 3 operates as either an evaporator or a condenser, whereby the heat exchange performance in heating operation and that in cooling operation can both be improved.

Figure 4:
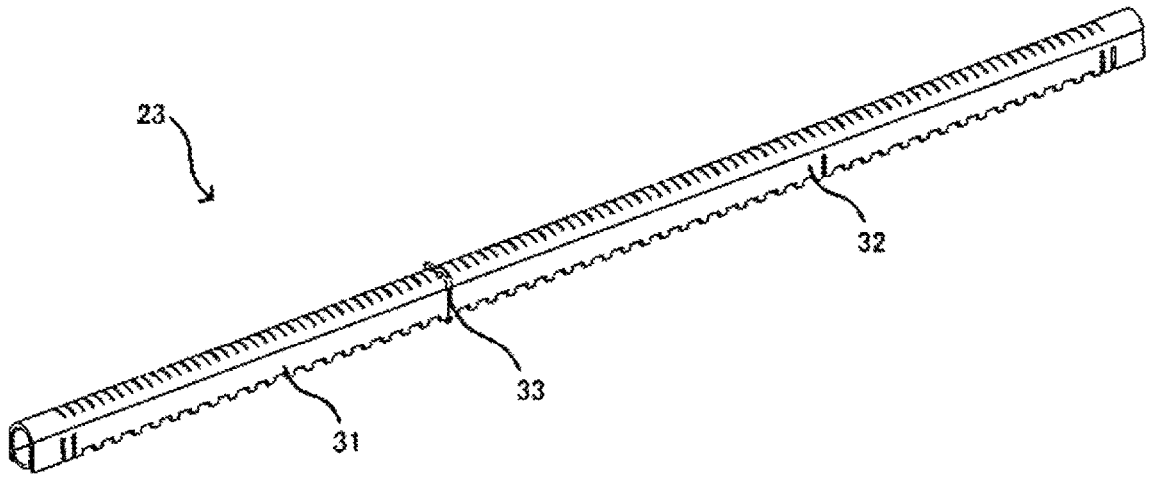
FIG. 4 is a perspective view illustrating a first header according to Embodiment 1 of the present disclosure.
Figure 5:
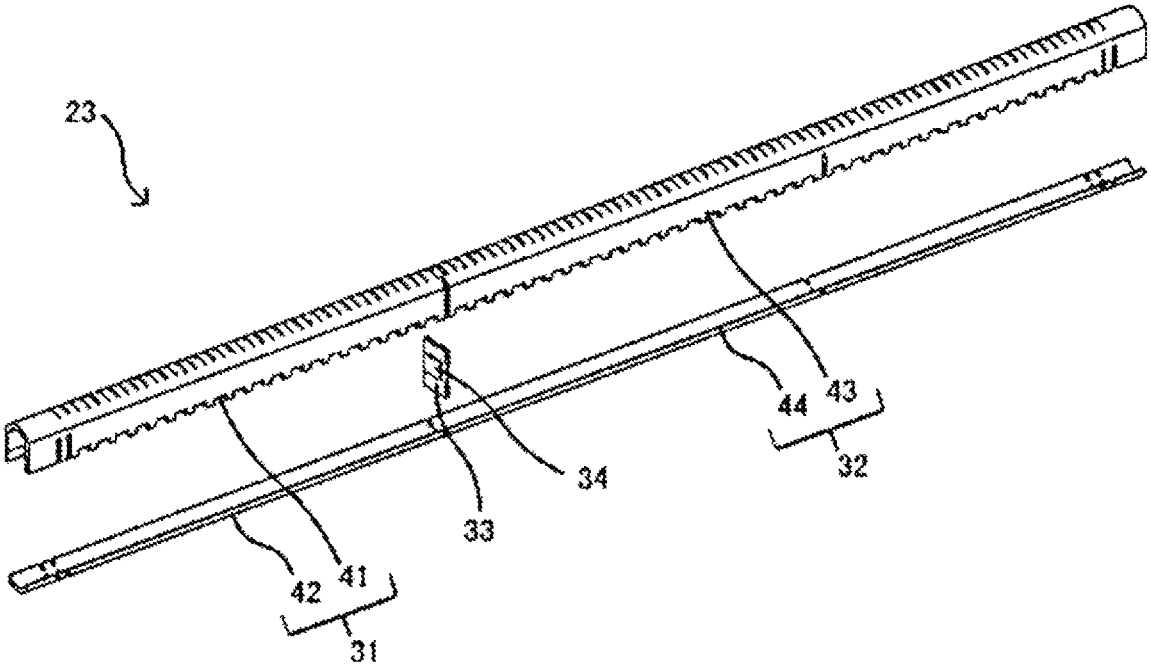
FIG. 5 is an exploded perspective view illustrating the first header according to Embodiment 1 of the present disclosure.
Figure 6:
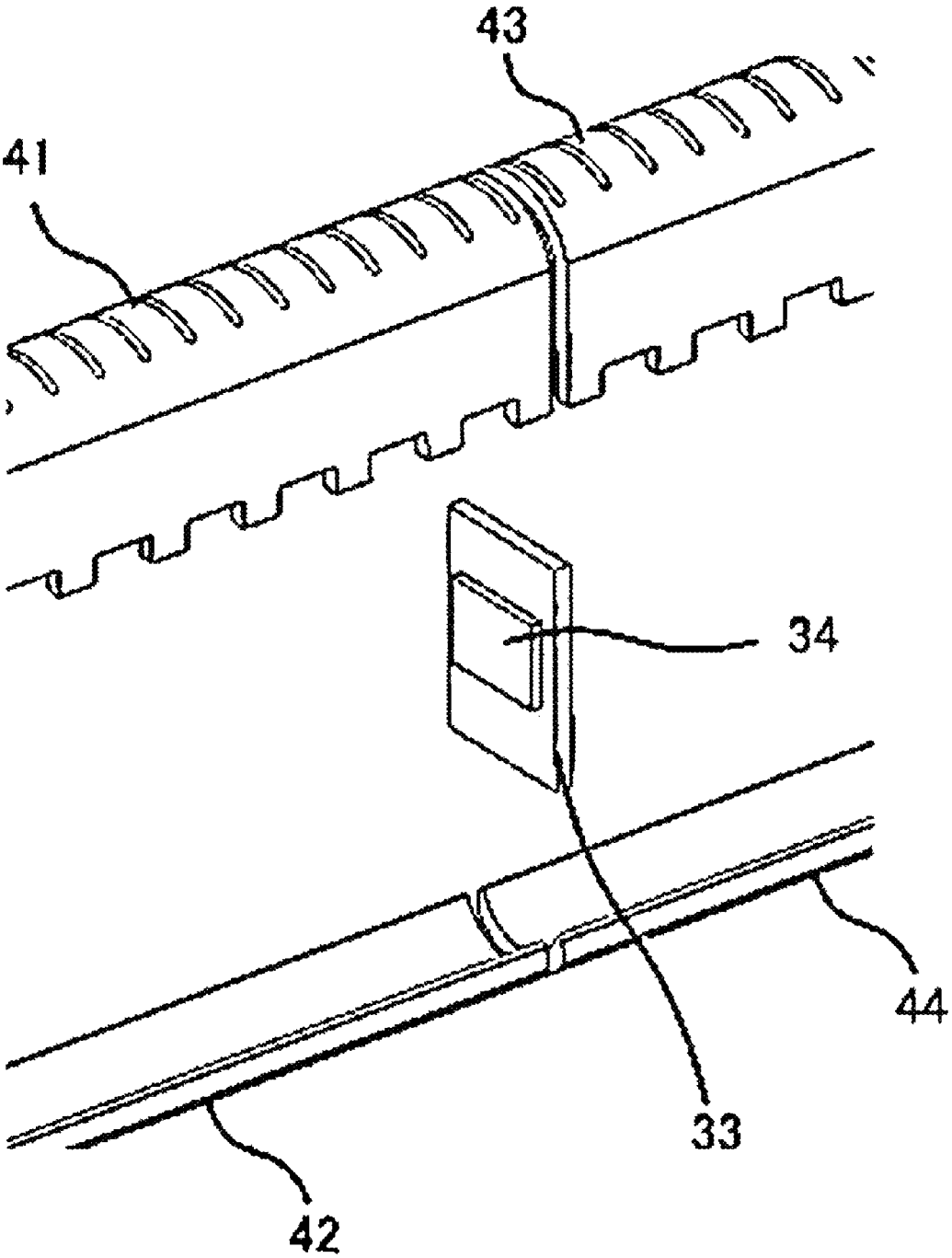
FIG. 6 is an exploded perspective view enlargedly illustrating part of the first header according to Embodiment 1 of the present disclosure.

Next, the configuration of the first header 23 according to Embodiment 1 will be described. FIG. 4 is a perspective view illustrating the first header 23 according to Embodiment 1 of the present disclosure. FIG. 5 is an exploded perspective view illustrating the first header 23 according to Embodiment 1 of the present disclosure. FIG. 6 is an exploded perspective view enlargedly illustrating part of the first header 23 according to Embodiment 1 of the present disclosure. The first header 23 includes the first main header portion 31, the first sub-header portion 32, and the partition plate 33 provided between the first main header portion 31 and the first sub-header portion 32.

The first main header portion 31 is provided to distribute refrigerant that flows therein from the gas pipe 12, to the flat tubes 21 of the main heat exchange portion 51, and to cause refrigerant that flows into the first main header portion 31 from the flat tubes 21 of the main heat exchange portion 51 to join together and then flow out from the gas pipe 12. As illustrated in FIG. 5, the first main header portion 31 includes an upper main header member 41 and a lower main header member 42. In the upper main header member 41, the flat tubes 21 of the main heat exchange portion 51 are inserted. The lower main header member 42 is combined with the upper main header member 41 to form a flow passage in the first main header portion 31.

The first sub-header portion 32 is provided to distribute refrigerant that flows therein from the liquid pipe 13, to the flat tubes 21 of the sub-heat exchange portion 52, and to cause refrigerant that flows into the first sub-header portion 32 from the flat tubes 21 of the sub-heat exchange portion 52, to join together, and to flow out of the liquid pipe 13. As illustrated in FIG. 5, the first sub-header portion 32 includes an upper sub-header member 43 and a lower sub-header member 44. In the upper sub-header member 43, the flat tubes 21 of the sub-heat exchange portion 52 are inserted. The lower sub-header member 44 is combined with the upper sub-header member 43 to form a flow passage in the first sub-header portion 32.

The partition plate 33 is provided to prevent refrigerant from directly passing between the first main header portion 31 and the first sub-header portion 32. The partition plate 33 is provided between the first main header portion 31 and the first sub-header portion 32, and joined to both the first main header portion 31 and the first sub-header portion 32. The partition plate 33 has a larger surface area than a sectional area of the first main header portion 31 and a sectional area of the first sub-header portion 32. Thus, the partition plate 33 is provided between the first main header portion 31 and the first sub-header portion 32, thereby preventing refrigerant from directly flowing between the first main header portion 31 and the first sub-header portion 32. Furthermore, the partition plate 33 is provided between the first main header portion 31 and the first sub-header portion 32 and is joined to the first main header portion 31 and the first sub-header portion 32 by brazing. Thus, if a defect is present in the brazed joint, refrigerant leaks out from the outdoor heat exchanger 3. Accordingly, whether the brazing is performed correctly or not can be easily checked. Thus, a defective product can be easily detected during the production process. It is therefore possible to prevent the defective product from being distributed to the market.

Furthermore, the partition plate 33 has protruding portions 34 on respective sides of the partition plate 33 that are joined to respective header portions, that is, the first main header portion 31 and the first sub-header portion 32. The protruding portions 34 are fitted in respective opening portions of the first main header portion 31 and the first sub-header portion 32. Because of provision of such a configuration, when the partition plate 33 is brazed to the first main header portion 31 and the first sub-header portion 32, the protruding portions 34 are fitted into the respective opening portions of the first main header portion 31 and the first sub-header portion 32, whereby the partition plate 33 can be easily positioned. Accordingly, the brazing process is facilitated.

As described above, the outdoor heat exchanger 3 according to Embodiment 1 includes: the heat exchange element 20 provided with the flat tubes 21 spaced from each other; and the first header 23 in which one end portion of each of the flat tubes 21 of the heat exchange element 20 is inserted. The first header 23 includes the first main header portion 31 in which some of the flat tubes 21 are inserted, the first sub-header portion 32 in which a smaller number of flat tubes 21 are inserted than the above flat tubes 21 inserted in the first main header portion 31, and the partition plate 33 provided between the first main header portion 31 and the first sub-header portion 32 and joined to both the first main header portion 31 and the first sub-header portion 32. The partition plate 33 has a surface area that is larger than the sectional area of the first main header portion 31 and the sectional area of the first sub-header portion 32.

In this configuration, if a defect is present at the brazed joint between the partition plate 33 and the first main header portion 31 and between the partition plate 33 and the first sub-header portion 32, refrigerant leaks out from the outdoor heat exchanger 3. It is therefore possible to easily check whether the brazing is performed correctly or not. Therefore, it is also possible to easily detect a defective product during the production process, and thus prevent the defective product from being distributed to the market.

Furthermore, in the outdoor heat exchanger 3 according to Embodiment 1, the partition plate 33 includes the protruding portions 34 on respective sides of the partition plate 33 that are joined to respective header portions, that is, the first main header portion 31 and the first sub-header portion 32. The protruding portions 34 are fitted in the respective opening portions of the first main header portion 31 and the first sub-header portion 32. In this configuration, when the partition plate 33 is provided between the first main header portion 31 and the first sub-header portion 32 and brazed thereto, the protruding portions 34 are fitted into the opening portions of the first main header portion 31 and the first sub-header portion 32, whereby the partition plate 33 can be easily positioned, and the brazing process is facilitated.

Furthermore, in the outdoor heat exchanger 3 according to Embodiment 1, the first main header portion 31 includes the upper main header member 41 and the lower main header member 42. In the upper header member 41, a plurality of flat tubes 21 are inserted. The lower main header member 42 is combined with the upper main header member 41 to form a flow passage in the first main header portion 31. The first sub-header portion 32 includes the upper sub-header member 43 and the lower sub-header member 44. In the upper sub-header member 43, the flat tubes 21 are inserted. The lower sub-header member 44 is combined with the upper sub-header member 43 to form a flow passage in the first sub-header portion 32.

In addition, the outdoor heat exchanger 3 according to Embodiment 1, the flat tubes 21 extend in the vertical direction, and are arranged and spaced from each other in the horizontal direction; the heat exchange elements 20 are provided in the flow direction of air; and the first header 23 is provided at the lower part of one of the heat exchange elements 20 that is located on the most upstream side in the flow of wind. By virtue of this configuration, in defrost operation, high-temperature gas refrigerant flows from the first header 23 into the heat exchange elements 20 from the lower side of the flat tubes 21 of the heat exchange element 20 which is located on the most upstream side in the flow of wind and on which the largest amount of frost is formed. Then, frost formed on a lower portion of the outdoor heat exchanger 3 is removed preferentially. As a result, water easily flows toward the downstream side of a drainage path, thereby promoting water drainage.

The outdoor heat exchanger 3 according to Embodiment 1 includes: the main heat exchange portion 51 including the first main header portion 31 and heat exchange elements 20 located closer to the first main header portion 31 than to the partition plate 33; the sub-heat exchange portion 52 including the first sub-header portion 32 and heat exchange elements 20 located closer to the first sub-header portion 32 than to the partition plate 33; and the second header 24 provided at the lower part of one of the heat exchange elements 20 that is located on the most downstream side in the flow of wind, such that the main heat exchange portion 51 and the sub-heat exchange portion 52 communicate with each other through the second header 24. In this configuration, the outdoor heat exchanger 3 has a portion in which refrigerant flows in the opposite direction to the flow direction of air in the case where the outdoor heat exchanger 3 operates as either an evaporator or a condenser, whereby the heat exchange performance in heating operation and that in cooling operation can both be improved.

Furthermore, in the outdoor heat exchanger 3 according to Embodiment 1, when the outdoor heat exchanger 3 operates as an evaporator, in the main heat exchange portion 51, a refrigerant flow passage is formed through which refrigerant flows into one of the heat exchange elements 20 that is located on the most downstream side in the flow of wind, via the second header 24, and then flows out from one of a plurality of heat exchange elements 20 that is located on the most upstream side in the flow of wind, whereby the refrigerant flows in the opposite direction to the flow direction of air. By virtue of this configuration, it is possible to ensure a temperature difference between air and refrigerant in the main heat exchange portion 51 in the process of heat exchange, and improve the heat exchange performance.

In addition, in the outdoor heat exchanger 3 according to Embodiment 1, when the outdoor heat exchanger 3 operates as a condenser, in the sub-heat exchange portion 52, a refrigerant flow passage is formed through which refrigerant flows into one of the heat exchange elements 20 that is located on the most downstream side in the flow of wind, via the second header 24, and then flows out from one of the heat exchange elements 20 that is located on the most upstream side of the airflow, whereby the refrigerant flows in the opposite direction to the flow direction of air. By virtue of this configuration, it is possible to ensure a temperature difference between air and refrigerant in the sub-heat exchange portion 52 in the process of heat exchange, and improve the heat exchange performance.

The outdoor unit 10 according to Embodiment 1 includes: the outdoor heat exchanger 3; the housing 9 which is formed in the shape of a box and in which the outdoor heat exchanger 3 is provided; and the fan 4 which is located on the top of the housing 9 and blows air upward. The outdoor heat exchanger 3 is provided in the upper portion of the housing 9. The outdoor unit 10 according to Embodiment 1 can obtain the same advantages as the outdoor heat exchanger 3 as described above.

The air-conditioning apparatus 100 according to Embodiment 1 includes the outdoor unit 10 as described above. The air-conditioning apparatus 100 according to Embodiment 1 can obtain the same advantages as the outdoor unit 10 as described above.

Embodiment 2

Figure 7:
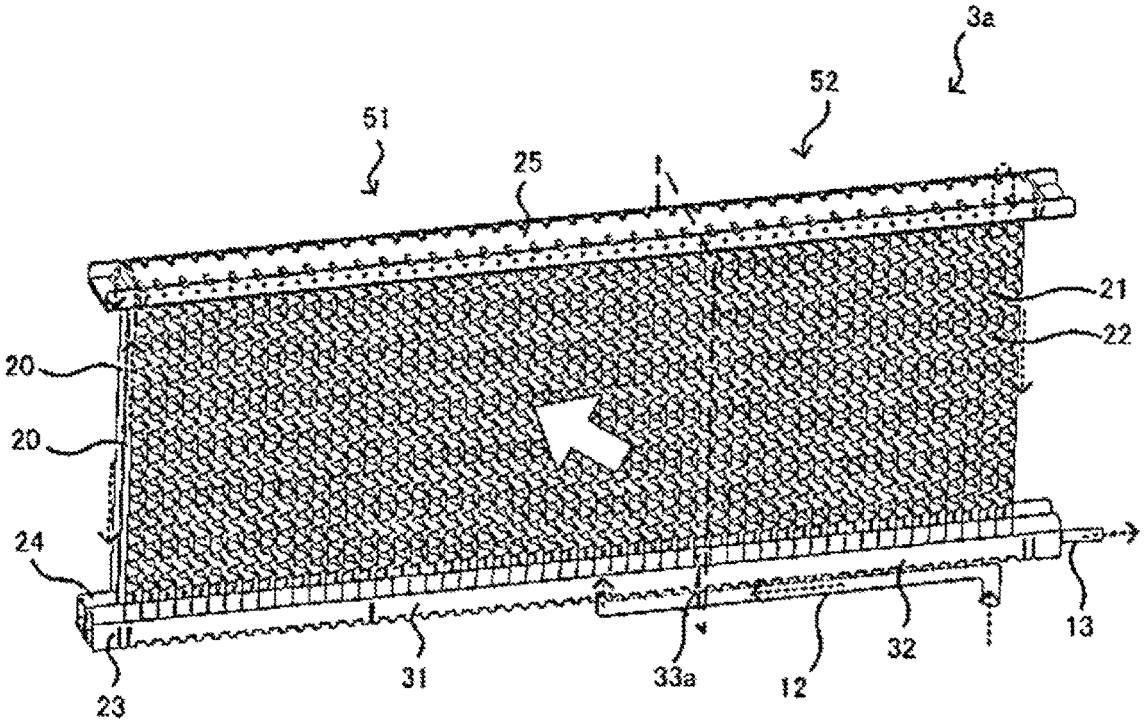
FIG. 7 is a perspective view illustrating an outdoor heat exchanger according to Embodiment 2 of the present disclosure.
Figure 8:
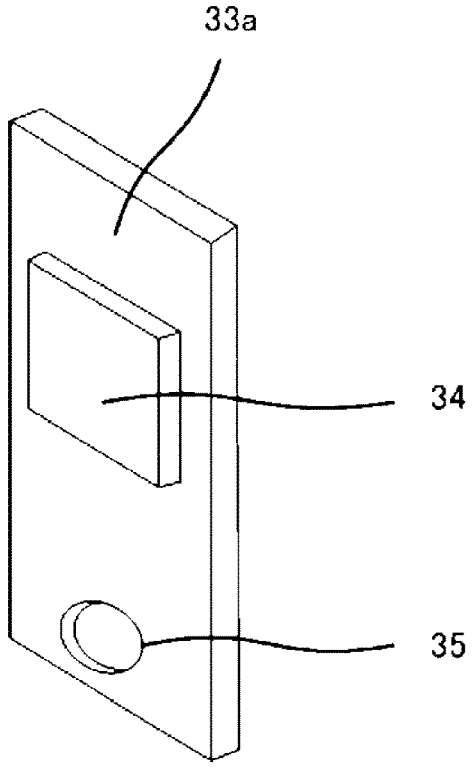
FIG. 8 is a perspective view illustrating a partition plate according to Embodiment 2 of the present disclosure.

An outdoor heat exchanger according to Embodiment 2 of the present disclosure will be described. FIG. 7 is a perspective view illustrating an outdoor heat exchanger 3*a* according to Embodiment 2 of the present disclosure. FIG. 8 is a perspective view illustrating a partition plate 33*a* according to Embodiment 2 of the present disclosure. In the outdoor heat exchanger 3*a* according to Embodiment 2, the gas pipe 12 connected to the first main header portion 31 is partially located below the first sub-header portion 32 and extends in a longitudinal direction thereof. In this regard, the outdoor heat exchanger 3*a* according to Embodiment 2 is different from the outdoor heat exchanger 3 according to Embodiment 1. Regarding the outdoor heat exchanger 3*a* according to Embodiment 2, components that are the same as those of the outdoor heat exchanger 3 according to Embodiment 1 will be denoted by the same reference signs, and their descriptions will thus be omitted. The outdoor heat exchanger 3*a* according to Embodiment 2 will be described by referring mainly to the differences between the outdoor heat exchanger 3*a* according to Embodiment 2 and the outdoor heat exchanger 3 according to Embodiment 1.

In the outdoor heat exchanger 3*a* according to Embodiment 2, the gas pipe 12 is connected to the first main header portion 31, and allows refrigerant to flow into the outdoor heat exchanger 3*a* when the outdoor heat exchanger 3*a* operates as a condenser, and allows refrigerant to flow out from the outdoor heat exchanger 3*a* to the refrigerant circuit when the outdoor heat exchanger 3*a* operates as an evaporator. The liquid pipe 13 is connected to the first sub-header portion 32, and allows refrigerant to flow out from the outdoor heat exchanger 3*a* to the refrigerant circuit when the outdoor heat exchanger 3*a* operates as a condenser, and allows refrigerant to flow into the outdoor heat exchanger 3*a* when the outdoor heat exchanger 3*a* operates as an evaporator. It should be noted that dotted arrows in FIG. 7 indicate the flow of refrigerant in the case where the outdoor heat exchanger 3*a* operates as a condenser.

As illustrated in FIG. 7, at least part of the gas pipe 12 is located below the first sub-header portion 32 and extends in the longitudinal direction thereof. Thus, the gas pipe 12 is located below the first header 23 and extends in the direction along the above longitudinal direction, from the first sub-header portion 32 to the location where the gas pipe 12 is connected to the first main header portion 31. At least part of the gas pipe 12 is located in contact with the first sub-header portion 32. By virtue of the above configuration, heat of high-temperature and high-pressure gas refrigerant that flows in the gas pipe 12 in defrost operation can be transferred to the first sub-header portion 32. In defrost operation, after transferring heat in the main heat exchange portion 51, refrigerant flows into the sub-heat exchange portion 52. Therefore, frost that is formed on the first sub-header portion 32 of the sub-heat exchange portion 52 and formed in the vicinity of the first sub-header portion 32 is not easily melted, compared to frost that is formed on the first main header portion 31 of the main heat exchange portion 51 and formed in the vicinity of the first main header portion 31. In view of that, at least part of the gas pipe 12 connected to the first main header portion 31 is located below the first sub-header portion 32 and extends in the longitudinal direction. By virtue of this configuration, it is possible to transfer heat of gas refrigerant that flows in the gas pipe 12 to the frost that is formed on and in the vicinity of the first sub-header portion 32 where a relatively large amount of frost is formed, and thus promote melting of the frost.

As illustrated in FIG. 8, the partition plate 33*a* includes an opening portion 35 that is provided at a lower portion of the partition plate 33*a* and that allows the gas pipe to pass through the opening portion 35 to support the gas pipe 12. When the gas pipe 12 is provided below the first sub-header portion 32 to extend in the longitudinal direction, and is also connected to the first main header portion 31, then the gas pipe 12 extends through the lower portion of the partition plate 33*a* provided between the first main header portion 31 and the first sub-header portion 32. Thus, the opening portion 35 is provided in the partition plate 33*a* at a position located below the protruding portions 34, and the gas pipe 12 is passed through the opening portion 35, whereby the partition plate 33*a* can support the gas pipe 12 in such a manner as to prevent the gas pipe 12 from hanging down.

As described above, the outdoor heat exchanger 3*a* according to Embodiment 2 further includes the gas pipe 12 which is connected to the first main header portion 31, from which refrigerant flows out when the outdoor heat exchanger 3*a* operates as an evaporator, and into which refrigerant flows when the outdoor heat exchanger 3*a* operates as a condenser. At least part of the gas pipe 12 is located below the first sub-header portion 32 and extends in the longitudinal direction thereof, and the partition plate 33 includes at the lower portion thereof, the opening portion 35 that allows the gas pipe 12 to pass therethrough and supports the gas pipe 12.

By virtue of the above configuration, it is possible to transfer heat of gas refrigerant that flows in the gas pipe 12 to frost formed on and in the vicinity of the first sub-header portion 32 where a large amount of frost is formed, and to thus promote melting of the frost. Furthermore, the gas pipe 12 located below the first main header portion 31 and the first sub-header portion 32 can be supported so as not to hand down.

Although the present disclosure is made by referring to the above embodiments, the technical scope of the present disclosure is not limited to the scope of the descriptions regarding the embodiments. Various changes or modifications can be made to the embodiments without departing from the scope of the disclosure, and embodiments to which the changes or modifications are made are also covered in the technical scope of the present disclosure.

For example, in Embodiment 1, the plurality of flat tubes 21 extend in the vertical direction, and are arranged and spaced from each other in the horizontal direction. However, in the outdoor heat exchanger 3 including the first header 23 having the first main header portion 31, the first sub-header portion 32, and the partition plate 33, the flat tubes 21 may extend in the horizontal direction, and may be arranged and spaced from each other in the vertical direction.

For example, in the present embodiment, the partition plate 33 is provided only in the first header 23 provided at the lower part of one of the heat exchange elements 20 that is located on the most upstream side in the flow of wind. However, in the case where it is necessary to prevent refrigerant from passing through the header, the same partition plate 33 as described above may be additionally provided in other headers such as the second header 24 and the return header 25.

The invention claimed is:

1. A heat exchanger comprising:

a heat exchange element including a plurality of flat tubes spaced from each other; and a first header in which one end portion of each of the plurality of flat tubes of the heat exchange element is inserted, wherein the first header includes a first main header portion in which some of the plurality of flat tubes are inserted, a first sub-header portion in which others of the plurality of flat tubes are inserted such that the number of the flat tubes inserted in the first sub-header portion is smaller than the number of the flat tubes inserted in the first main header portion, and a partition plate provided between the first main header portion and the first sub-header portion, and joined to both the first main header portion and the first sub-header portion, the partition plate has a surface area that is larger than a sectional area of the first main header portion and a sectional area of the first sub-header portion, and the partition plate includes protruding portions located on respective sides of the partition plate, fitted in respective opening portions of the first main header portion and the first sub-header portion.

2. The heat exchanger of claim 1, wherein the protruding portions are joined to the first main header portion and the first sub-header portion.

3. The heat exchanger of claim 1, wherein the first main header portion includes an upper main header member and a lower main header member, the upper main header member being a main header member in which the flat tubes inserted in the first main header portion are inserted, the lower main header member being combined with the upper main header member to form a flow passage in the first main header portion, and the first sub-header portion includes an upper sub-header member and a lower sub-header member, the upper sub-header member being a sub-header member in which the flat tubes inserted in the first sub-header portion is inserted, the lower sub-header member being combined with the upper sub-header member to form a flow passage in the first sub-header portion.

4. The heat exchanger of claim 1, wherein the flat tubes extend in a vertical direction, and are spaced from each other in a horizontal direction, a plurality of heat exchange elements identical to the heat exchange element are provided in a flow direction of air, and the first header is provided at lower part of one of the plurality of heat exchange elements that is located on a most upstream side in a flow of wind.

5. The heat exchanger of claim 4, further comprising:

a main heat exchange portion including the first main header portion and ones of the plurality of heat exchange elements that are located closer to the first main header portion than to the partition plate;

a sub-heat exchange portion including the first sub-header portion and ones of the plurality of heat exchange elements that are located closer to the first sub-header portion than to the partition plate; and a second header provided at lower part of one of the plurality of heat exchange elements that is located on a most downstream side in the flow of wind, such that the main heat exchange portion and the sub-heat exchange portion communicate with each other through the second header.

6. The heat exchanger of claim 5, wherein when the heat exchanger operates as an evaporator, in the main heat exchange portion, a refrigerant flow passage is provided through which refrigerant flows into the one of the plurality of heat exchange elements that is located on the most downstream side in the flow of wind, via the second header, and then flows out of the one of the plurality of the heat exchange elements that is located on the most upstream side in the flow of wind, whereby refrigerant flows in the opposite direction to a flow direction of air.

7. The heat exchanger of claim 5, wherein when the heat exchanger operates as a condenser, in the sub-heat exchange portion, a refrigerant flow passage is provided through which refrigerant flows into the one of the plurality of heat exchange elements that is located on the most downstream side in the flow of wind, via the second header, and then flows out from the one of the plurality of heat exchange elements that is located on the most upstream side in the flow of wind, whereby refrigerant flows in the opposite direction to a flow direction of air.

8. The heat exchanger of claim 5, further comprising a gas pipe connected to the first main header portion such that refrigerant flows out from the gas pipe when the heat exchanger operates as an evaporator, and refrigerant flows into the gas pipe when the heat exchanger operates as a condenser, wherein at least part of the gas pipe is located below the first sub-header portion and extends in a longitudinal direction thereof, and the partition plate includes an opening portion at a lower portion of the partition plate, the opening portion allowing the gas pipe to pass though the opening portion and supporting the gas pipe passing through the opening portion.

9. An outdoor unit comprising:

the heat exchanger of claim 1;

a housing which is formed in the shape of a box and in which the heat exchanger is provided; and a fan located on a top of the housing and configured to blow air upward, wherein the heat exchanger is provided in an upper portion of the housing.

10. An air-conditioning apparatus comprising the outdoor unit of claim 9.

11. A heat exchanger comprising:

a heat exchange element including a plurality of flat tubes spaced from each other; and a first header in which one end portion of each of the plurality of flat tubes of the heat exchange element is inserted, wherein the first header includes a first main header portion in which some of the plurality of flat tubes are inserted, a first sub-header portion in which others of the plurality of flat tubes are inserted such that the number of the flat tubes inserted in the first sub-header portion is smaller than the number of the flat tubes inserted in the first main header portion, and a partition plate provided between the first main header portion and the first sub-header portion, and joined to both the first main header portion and the first sub-header portion, and the partition plate has a surface area that is larger than a sectional area of the first main header portion and a sectional area of the first sub-header portion, the first main header portion includes an upper main header member and a lower main header member, and the first sub-header portion includes an upper sub-header member and a lower sub-header member.

12. The heat exchanger of claim 11, wherein the partition plate includes protruding portions located on respective sides of the partition plate that are joined to the first main header portion and the first sub-header portion, the protruding portions being fitted in respective opening portions of the first main header portion and the first sub-header portion.

13. The heat exchanger of claim 11, wherein the flat tubes extend in a vertical direction, and are spaced from each other in a horizontal direction, a plurality of heat exchange elements identical to the heat exchange element are provided in a flow direction of air, and the first header is provided at lower part of one of the plurality of heat exchange elements that is located on a most upstream side in a flow of wind.

14. An outdoor unit comprising:

the heat exchanger of claim 11;

a housing which is formed in the shape of a box and in which the heat exchanger is provided; and a fan located on a top of the housing and configured to blow air upward, wherein the heat exchanger is provided in an upper portion of the housing.

15. An air-conditioning apparatus comprising the outdoor unit of claim 14.

16. A heat exchanger comprising:

a heat exchange element including a plurality of flat tubes spaced from each other; and a first header in which one end portion of each of the plurality of flat tubes of the heat exchange element is inserted, wherein the first header includes a first main header portion in which some of the plurality of flat tubes are inserted, a first sub-header portion in which others of the plurality of flat tubes are inserted such that the number of the flat tubes inserted in the first sub-header portion is smaller than the number of the flat tubes inserted in the first main header portion, and a partition plate provided between the first main header portion and the first sub-header portion, and joined to both the first main header portion and the first sub-header portion, and the partition plate has a surface area that is larger than a sectional area of the first main header portion and a sectional area of the first sub-header portion, the partition plate includes an opening portion at a lower portion of the partition plate, the opening portion allowing the gas pipe to pass through the opening portion and supporting the gas pipe passing through the opening portion.

17. The heat exchanger of claim 16, wherein the partition plate includes protruding portions located on respective sides of the partition plate that are joined to the first main header portion and the first sub-header portion, the protruding portions being fitted in respective opening portions of the first main header portion and the first sub-header portion.

18. The heat exchanger of claim 16, wherein the flat tubes extend in a vertical direction, and are spaced from each other in a horizontal direction, a plurality of heat exchange elements identical to the heat exchange element are provided in a flow direction of air, and the first header is provided at lower part of one of the plurality of heat exchange elements that is located on a most upstream side in a flow of wind.

19. An outdoor unit comprising:

the heat exchanger of claim 16;

a housing which is formed in the shape of a box and in which the heat exchanger is provided; and a fan located on a top of the housing and configured to blow air upward, wherein the heat exchanger is provided in an upper portion of the housing.

20. An air-conditioning apparatus comprising the outdoor unit of claim 19.

* * * * *